United States Patent [19]

Latimer et al.

[11] 3,991,568

[45] Nov. 16, 1976

[54] METHOD FOR SUPPLYING UNAERATED HYDRAULIC FLUID TO A WORK SYSTEM

[75] Inventors: Eugene E. Latimer, Wilmington; Larry W. Lorimor, Crest Hill, both of Ill.

[73] Assignee: Caterpillar Tractor Co., Peoria, Ill.

[22] Filed: Apr. 4, 1975

[21] Appl. No.: 565,176

Related U.S. Application Data

[62] Division of Ser. No. 502,826, Sept. 3, 1974.

[52] U.S. Cl. ..... 60/327; 60/453; 60/477; 137/1

[51] Int. Cl.[2] ..... E03B 1/00

[58] Field of Search ..... 137/1, 563, 575, 571, 137/544, 576; 210/132, 232; 60/477, 336, 453, 478, DIG. 5, 327

[56] References Cited

UNITED STATES PATENTS

| | | | |
|---|---|---|---|
| 1,888,953 | 11/1932 | Humphrey | 137/1 |
| 2,211,753 | 8/1940 | Leopold | 137/563 |
| 2,243,446 | 5/1941 | Terlesky | 137/563 |
| 2,287,396 | 6/1942 | Roth | 137/575 |
| 2,490,319 | 12/1949 | Palsgrove | 137/575 |
| 2,742,914 | 4/1956 | Hannay et al. | 137/1 |
| 3,222,865 | 12/1965 | Miller | 60/DIG. 5 |
| 3,269,541 | 8/1966 | Neely | 210/132 |

*Primary Examiner*—William R. Cline
*Assistant Examiner*—H. Jay Spiegel
*Attorney, Agent, or Firm*—Phillips, Moore, Weissenberger, Lempio & Strabala

[57] ABSTRACT

A hydraulic circuit comprises a first tank elevated above a second tank and openly communicating therewith by a conduit adapted to continuously maintain the second tank at full capacity with a hydraulic fluid. The hydraulic fluid is pumped out of the second tank and to a work system wherefrom it is recircuited back through a filtering system, retained in the first tank. Upon malfunctioning of the filtering system to prevent the egress of hydraulic fluid therethrough, the increased pressure level of the recircuited hydraulic fluid will function to open a directional control check valve in the second tank to by-pass the conduit normally communicating hydraulic fluid from the first tank to the second tank.

3 Claims, 1 Drawing Figure

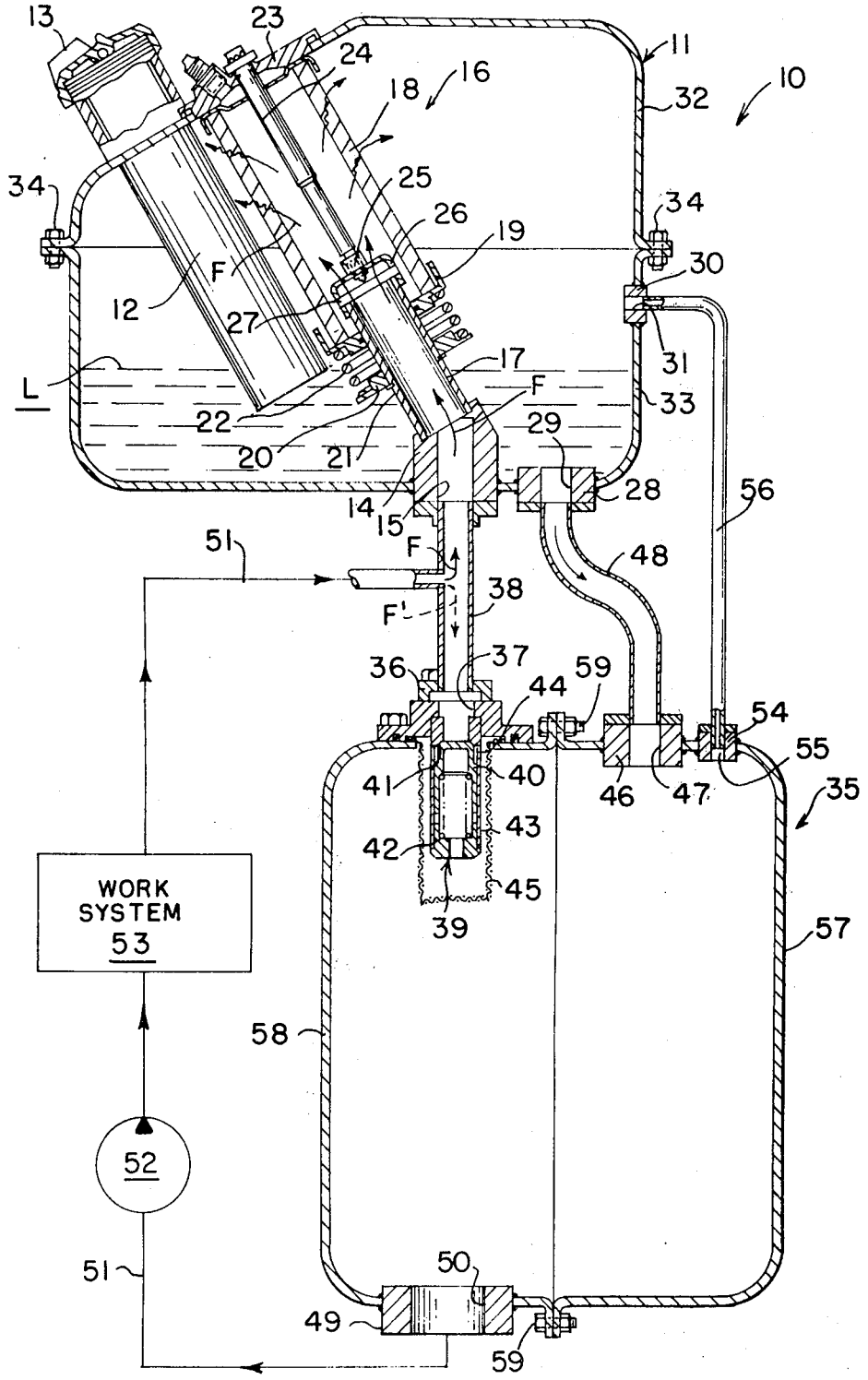
WORK
SYSTEM
53

METHOD FOR SUPPLYING UNAERATED HYDRAULIC FLUID TO A WORK SYSTEM

This is a division of Ser. No. 502,826, filed Sept. 3, 1974.

BACKGROUND OF THE INVENTION

Dual tank systems are oftentimes employed in a hydraulic circuit for an earthworking vehicle to continuously communicate an adequate supply of hydraulic fluid to work implements employed in such circuit. Each of the tanks normally contains a substantial pocket of air therein to induce an undesirable aeration of the hydraulic fluid contained therein. A system of this type is disclosed in U.S. Pat. No. 3,604,205, assigned to the assignee of this application. U.S. Pat. No. 3,222,866 also discloses a dual tank system wherein a rather complicated circuitry is utilized in an attempt to maintain a lower tank in a filled condition.

SUMMARY OF THIS INVENTION

An object of this invention is to provide an improved dual tank system in a hydraulic circuit and a method for continuously supplying unaerated hydraulic fluid to a work system employed in such circuit. The circuit comprises a first tank and a second tank disposed therebelow with means communicating pressurized hydraulic fluid from an outlet of the second tank, through a work system and to an inlet to the first tank. Means are also provided for communicating an unobstructed flow of hydraulic fluid from an outlet of the first tank to an inlet of the second tank to continuously maintain the second tank at its full capacity.

In the preferred embodiment of this invention, the inlet to the first tank further communicates with another inlet to the second tank which has a normally closed valve mounted thereat. The valve is adapted to open when the fluid pressure at the inlet to the first tank exceeds a predetermined level. Hydraulic fluid is thus communicated from the work system to the second tank directly, upon malfunctioning of a filtering system disposed in the first tank.

BRIEF DESCRIPTION OF THE DRAWING

Other objects of this invention will become apparent from the following description and accompanying drawing which illustrates a partially sectioned hydraulic fluid circuit employing the dual tank system of this invention therein.

DETAILED DESCRIPTION

FIG. 1 illustrates a hydraulic fluid circuit 10 comprising a first closed tank 11 adapted to be partially filled with a hydraulic fluid to a level L, via a fill spout 12 having a closed cap 13 removably attached thereon. The lower end of the spout establishes the maximum of such level (due to the dead air pocket maintained in the first tank) and preferably teminates upwardly from a bottom wall of the first tank. A first mounting flange 14 is secured on the bottom wall of the tank to provide an inlet 15 communicating interiorly of the tank through a filter assembly 16. The filter assembly comprises an upwardly extending tubular sleeve 17 having its lower end secured to the mounting flange 14 and having a cartridge-type filter element 18 mounted on the upper end thereof.

The lower end of the replaceable filter element is mounted in a cup-shaped member 19 slidably mounted on sleeve 17. An annular retainer 20 is attached in place on the sleeve by a snap ring 21 and a coil spring 22 is mounted on the sleeve, between the retainer and member 19, to urge filter 18 upwardly against an annular cover 23. The cover is adapted to be removed to expose the filter element, via a circular aperture formed through a top wall of the first tank, upon release of a lag bolt 24, having its lower end threadably mounted in a nut 25.

The nut is secured to a strap 26 secured to an upper, open end of tube 17 by a removable cross-pin 27. The pin and strap are disposed on the end of tube 17 to permit a substantial flow of hydraulic fluid thereby and through the filter, as indicated by primary flow arrows F. A secondary flow arrow F′ depicts an alternate flow path assumed by the hydraulic fluid in the event filter 18 becomes clogged, for example.

Tank 11 further comprises a second mounting flange 28 secured on a bottom wall thereof, adjacent to first mounting flange 14, to define an outlet 29. A third mounting flange 30 is secured to a sidewall of tank 11 to define a second inlet 31, above level L of the hydraulic fluid. The tank preferably comprises a pair of deep drawn sections 32 and 33 secured together at peripheral mounting flanges thereof by a plurality of circumferentially disposed cap screws 34.

A second tank 35 is disposed below the first tank and has a first mounting flange 36 secured thereon to define a first inlet 37. A first passage means is defined in a conduit 38, secured between flanges 14 and 36, to communicate inlets 15 and 37 thereof. A valve means 39, preferably comprising a directional control check valve functioning as a by-pass valve, normally closes inlet 37 and is openable when the hydraulic fluid in the first passage means exceeds a predetermined pressure level.

The valve means comprises a spool 40 biased upwardly against an annular seat 41 by a compression coil spring 42. The spool is reciprocally mounted in a sleeve 43 secured to flange 36 and having radial ports 44 formed therethrough to communcate hydraulic fluid from conduit 38 and inlet 37, interiorly of tank 35. A tubular wire mesh screen filter 45 is suitably secured to tank 35 to encapsulate valve means 39 to filter out contaminants prior to their egress into the tank.

A second mounting flange 46 is secured on the top of tank 35 and defines a second inlet 47 openly communicating with inlet 29 via a second passage means, defined by a conduit 48 secured between mounting flanges 28 and 46. A third mounting flange 49 is secured on a bottom wall of the tank to define an outlet 50 thereat. A third passage means, schematically illustrated by lines 51, communicates outlet 50 with the first passage means defined in conduit 38.

A conventional engine-driven pump means 52 is connected in passage means 51 for pumping pressurized hydraulic fluid from the second tank, through a work system 53 and into conduit 38. Work system 53 may comprise one or more valve-controlled hydraulic actuators employed on an earthworking vehicle, for example. Such actuators normally take the form of double-acting hydraulic cylinders adapted to selectively actuate one or more work implements under the control of the vehicle's operator.

A fourth mounting flange 54 is secured on the top of the second tank to provide a second outlet 55 communicating with inlet 31 of first tank 11, via a conduit 56 secured between mounting flanges 30 and 54. The conduit defines a fourth passage means therein for venting any air, accumulating at the top of second tank 35, back to the first tank. The second tank, like the first tank, may comprise a pair of deep drawn sections 57 and 58 secured together at peripheral mounting flanges thereof by a plurality of circumferentially disposed cap screws 59.

In operation, engine driven pump 52 functions to supply work system 53 with pressurized hydraulic fluid from second tank 35 via outlet 50 thereof. The fluid is returned to inlet 15 of the first tank and proceeds upwardly through sleeve 17 whereupon it flows radially outwardly through filter 18 into the first tank, as depicted by primary flow arrows F. Conduit 48 continuously communicates an unobstructed hydraulic fluid flow from the first tank to the second tank 35 under the influence of gravity to keep it at its full capacity. As mentioned above, any air trapped in the second tank will be vented to the first tank via conduit 56.

Should the inlet to the first tank become obstructed, such as by a clogged filter element 18, valve means 39 will open when the fluid pressure in the first passage means of conduit 38 exceeds a predetermined level. The valve will thus permit hydraulic fluid in line 51 to follow secondary flow arrow F′ and be communicated to second tank 35 directly, via ports 44.

We claim:

1. A method for continuously supplying unaerated hydraulic working fluid to a work system comprising the steps of maintaining a predetermined level of hydraulic working fluid in a first tank, maintaining a second tank at its full capacity with said hydraulic working fluid by continuously communicating an unobstructed flow of hydraulic working fluid in closed communication from said first tank to said second tank under the influence of gravity, pumping pressurized and unaerated hydraulic working fluid in closed communication from said second tank, through said work system to translate energy of said hydraulic working fluid into mechanical energy and back to said first tank and by-passing communication of hydraulic working fluid back to said first tank when the pressure level at an inlet thereof exceeds a predetermined level by communicating such hydraulic working fluid from said work system to said second tank directly.

2. The method of claim 1 further comprising the step of filtering said hydraulic working fluid upon egress thereof into said first tank.

3. The method of claim 1 further comprising the step of venting any air from an upper portion of said second tank above the level of hydraulic working fluid in said first tank.

* * * * *